US007335234B2

(12) United States Patent
Jones, Jr.

(10) Patent No.: US 7,335,234 B2
(45) Date of Patent: Feb. 26, 2008

(54) METHOD OF TREATING FIBERS, CARPET YARNS AND CARPETS TO ENHANCE REPELLENCY

(75) Inventor: Dennis J. Jones, Jr., Dalton, GA (US)

(73) Assignee: Columbia Insurance Company, Omaha, NE (US)

( * ) Notice: Subject to any disclaimer, the term of this patent is extended or adjusted under 35 U.S.C. 154(b) by 345 days.

(21) Appl. No.: 10/271,808

(22) Filed: Oct. 16, 2002

(65) Prior Publication Data

US 2004/0074011 A1 Apr. 22, 2004

(51) Int. Cl.
*B05D 3/04* (2006.01)
*D06M 15/66* (2006.01)
*C08L 83/04* (2006.01)

(52) U.S. Cl. ..... 8/115.64; 8/181; 8/194; 8/196; 427/346; 427/377; 427/387; 427/389.9

(58) Field of Classification Search ..... 427/346, 427/377, 387, 389.9; 252/8.6; 8/115.64, 8/181, 194, 196
See application file for complete search history.

(56) References Cited

U.S. PATENT DOCUMENTS

| | | | | |
|---|---|---|---|---|
| 1,901,536 | A | 3/1933 | Schafer | |
| 1,972,754 | A | 9/1934 | Biedermann | |
| 1,988,985 | A | 1/1935 | Schafer | |
| 2,036,161 | A | 3/1936 | Schuette | |
| 2,112,361 | A | 3/1938 | Fischer | |
| 2,171,806 | A | 9/1939 | Russell et al. | |
| 2,581,390 | A | 1/1952 | De Groote et al. | |
| 3,221,079 | A | 11/1965 | Harris | |
| 3,433,666 | A | 3/1969 | Moyse et al. | |
| 3,650,801 | A | 3/1972 | Hinton, Jr. et al. | |
| 3,824,125 | A | 7/1974 | Hinton, Jr. | |
| 3,843,576 | A | 10/1974 | Parkinson | |
| 3,849,162 | A | 11/1974 | Mueller et al. | |
| 3,949,124 | A | 4/1976 | Jilla | |
| 4,351,736 | A | 9/1982 | Steinberger et al. | |
| 4,380,451 | A | 4/1983 | Steinberger et al. | |
| 4,501,591 | A | 2/1985 | Ucci et al. | |
| 4,592,940 | A | 6/1986 | Blyth et al. | |
| 4,680,212 | A | 7/1987 | Blyth et al. | |
| 4,780,099 | A | 10/1988 | Greschler et al. | |
| 4,781,844 | A * | 11/1988 | Kortmann et al. | 428/423.1 |
| 4,822,373 | A | 4/1989 | Olson et al. | |
| 4,839,212 | A | 6/1989 | Blyth et al. | |
| 4,857,392 | A | 8/1989 | Kirjanov et al. | |
| 4,865,885 | A | 9/1989 | Herlant et al. | |
| 4,875,901 | A | 10/1989 | Payet et al. | |
| 4,877,538 | A | 10/1989 | Kirjanov et al. | |
| 4,937,123 | A | 6/1990 | Chang et al. | |
| 5,073,442 | A | 12/1991 | Knowlton et al. | |
| 5,084,306 | A | 1/1992 | McLellan et al. | |
| 5,115,013 | A | 5/1992 | Rottger et al. | |
| 5,219,620 | A | 6/1993 | Potter et al. | |
| 5,310,828 | A | 5/1994 | Williams | |
| 5,366,161 | A | 11/1994 | Potter et al. | |
| 5,508,370 | A | 4/1996 | Reiff et al. | |
| 5,520,962 | A | 5/1996 | Jones, Jr. | |
| 5,670,246 | A | 9/1997 | Pechhold et al. | |
| 5,712,348 | A | 1/1998 | Pechhold | |
| 5,728,669 | A * | 3/1998 | Tyerech | 510/280 |
| 5,753,569 | A | 5/1998 | Michels et al. | |
| 5,759,431 | A | 6/1998 | Nguyen | |
| 5,851,595 | A | 12/1998 | Jones, Jr. | |
| 5,948,480 | A | 9/1999 | Murphy | |
| 6,197,378 | B1 | 3/2001 | Clark et al. | |
| 6,221,944 | B1 | 4/2001 | Liebeskind et al. | |
| 6,468,587 | B2 * | 10/2002 | Chang et al. | 427/346 |
| 2002/0025442 | A1 | 2/2002 | Chang et al. | |

FOREIGN PATENT DOCUMENTS

| | | |
|---|---|---|
| EP | 0 235 980 A1 | 9/1987 |
| EP | 0 267 681 A2 | 5/1988 |
| EP | 0 268 374 A2 | 5/1988 |
| EP | 0 328 822 A2 | 8/1989 |
| EP | 0 329 899 A2 | 8/1989 |

OTHER PUBLICATIONS

Anton, A., "Polyamide Fiber Reactive Chemical Treatments for Differential Dyeability," - - - , vol. 13, No. 2, pp. 31-35 (1981).
BAYGARD® SNF, "For dry soil repellent finishing and pile stabilization of carpets and other pile fabrics," Product Information (Mar. 2002).
Carr, J., "Nylon and the Carpet Industry," *Textile Horizons*, pp. 43-45 (Jun. 1988).
Greschler, I., "Stain-Resistant Polyamide Fibers with Resistance to Yellowing by Nitrogen Dioxide," *Chemical Abstacts*, vol. 108, No. 2, p. 72 (1988).
Jose, D.J., "Stain Resistant Carpets," *Textile Journal* (Nov. 1988).
"Leukotan Acrylic Syntans Product Summary," *Rohm and Haas Leather Chemicals*, Rohm and Haas Company (1985).
"Leukotan 970 Acrylic Syntan," *Rohm and Haas Leather Chemicals*, Rohm and Haas Company (1984).
Lipson, M., "Use of Polymers to Immunize Wool Against Acid Dyes," *Nature*, vol. 57 (Jun. 1, 1946).
Liss, T.A., "Stain and Yellowing-Resistant Polyamide Fabrics," *Chemical Abstracts*, vol. 108, No. 6, p. 86 (Feb. 1988).
Porter, R., "Acrylic Syntans for Retanning Leather," *Leather*, pp. 93-95, 101 (Sep. 1969).
"Retan 540," *Rohm and Haas Leather Chemicals*, Rohm and Haas Company (1981).
Shima, T., "Antistatic, Stain-Resistant Polyester Textiles," *Chemical Abstracts*, vol. 81, p. 72 (Jul. 1974).
Shortland, F.J.D., "The Role of Acrylics in Wet Processing," *Journal of the Society of Leather Technologists and Chemists*, vol. 64, No. 3, p. 60 (May-Jun. 1980).

* cited by examiner

*Primary Examiner*—Harold Pyon
*Assistant Examiner*—Preeti Kumar
(74) *Attorney, Agent, or Firm*—Merchant & Gould, LLC

(57) ABSTRACT

Methods of enhancing repellency of fibers, carpet yarns and carpets are disclosed. Compositions used to enhance the repellency of fibers, carpet yarns and carpets are also disclosed.

33 Claims, No Drawings

METHOD OF TREATING FIBERS, CARPET YARNS AND CARPETS TO ENHANCE REPELLENCY

FIELD OF THE INVENTION

The present invention is directed to methods and compositions for treating fibers, and especially carpet yarns and carpets.

BACKGROUND OF THE INVENTION

The present invention relates to the field of fiber treatment and carpet manufacture, and more particularly relates to methods of treating fibers, carpet and carpet yarn to enhance the repellency and, desirably, the stain-resistance of the fiber, carpet and carpet yarn.

In the last two decades, there has been considerable interest in developing treatments for carpet fibers, particularly nylon carpet fibers, to enhance repellency and stain-resistance. There is a continued need in the art to further develop methods of providing soil and/or stain-resistance to fibers, carpet yarns and carpets.

SUMMARY OF THE INVENTION

The present invention addresses some of the difficulties and problems discussed above by the discovery of a method of treating fibers, and especially carpet yarns to enhance the repellency of the fibers and carpet yarns. The method provides a desired amount of exhaustion of fluorochemicals onto and into the fiber or carpet yarn. In one exemplary embodiment of the present invention, carpet yarn alone or in the form of a tufted carpet is brought into contact with an aqueous treating composition having a pH below about 3.5 and containing a repellency compound comprising an anionic or non-ionic fluorochemical and an organosilicate polymer. The coated carpet yarn is desirably heated to remove excess water from the carpet.

In a further exemplary embodiment of the present invention, the aqueous treating composition contains an anionic polymer-binding compound, such as a polymer of methacrylic acid. The anionic polymer-binding compound provides additional stain-resistance to the finished carpet yarn.

The present invention is further directed to an aqueous treating composition for treating fibers, carpet yarns and carpets to enhance the repellency and stain-resistance of the fibers, carpet yarns and carpets. The aqueous treating composition may contain a fluorochemical compound, an organosilicate polymer, and an anionic polymer-binding compound.

The present invention is also directed to a method of increasing the exhaustion of a fluorochemical compound into a fiber or carpet yarn. The method comprises incorporating an organosilicate polymer into an aqueous treating composition for treating fibers, carpet yarns and carpets, wherein the aqueous treating composition contains a fluorochemical compound.

These and other features and advantages of the present invention will become apparent after a review of the following detailed description of the disclosed embodiments and the appended claims.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

Various types of fibers and carpet yarns can be treated according to the present invention. Desirably, the method of the present invention is used to treat carpet, namely carpet yarn tufted into a backing material. Alternatively, the carpet yarn or fiber may be treated according to the method of the present invention prior to being tufted into a backing material.

Throughout the description of the present invention, a number of terms are used to describe aspects of the present invention. As used herein, the term "repellency" is intended to have a relatively broad meaning, referring to a reduced tendency for soil, oil and/or water to adhere to the carpet fibers. As used herein, the term "stain-resistance" is also intended to have a relatively broad meaning, referring to a reduced tendency of the carpet fibers to be stained by acid dyes and/or disperse dyes.

I. Fibers, Carpet Yarns and Carpets

The present invention may be practiced using a variety of fibers and carpet yarns formed from fibers. Typically, the carpet yarn comprises an extruded synthetic polymer, such as nylon, polyester, polypropylene, or a combination thereof. Alternatively, the carpet yarn may be made from natural fibers, such as wool or cotton, or a combination of natural fibers and synthetic fibers. Desirably, the carpet yarn comprises extruded fibers of nylon 6, nylon 6,6, polyester, polypropylene, or a combination thereof.

The extruded fibers may be made into yarn by various conventional means. Desirably, the yarn is a bulk continuous filament yarn, which is heat-set by conventional means, such as the Superba or the Suessen method. Alternatively, the yarn may be a staple spun yarn. Desirably, the yarn is not pre-treated with a fluorochemical by the yarn manufacturer.

In one embodiment of the present invention, the carpet yarn is already tufted by conventional means into a carpet structure prior to being treated by the method of the present invention. The stitch pattern and density of the tufted carpet do not appear to be critical factors in the practice of the present invention. Also, in some cases, if the carpet is to receive a dye treatment, such as application of an acid dye, it is desirable for the carpet to complete dye treatment prior to treating the carpet using the method of the present invention.

II. Treating Compositions for Carpet Yarns and Carpets

The aqueous treating compositions of the present invention contain one or more of the following components.

A. Fluorochemical Compounds

The aqueous treating compositions of the present invention contain at least one fluorochemical compound. The fluorochemical compound may be an anionic or nonionic fluorochemical. Further, the fluorochemical compound may be either a telomer type or an electrochemically fluorinated fluorochemical. Several commercially available fluorochemical compounds are suitable for use in the present invention. Suitable fluorochemical compounds include, but are not limited to, DAIKIN TG 571, TG 472, TG 3360 and TG 3311, all of which are commercially available from Daikin America, Inc. (Orangeburg, N.Y.); FX-1367F, FX-1355, PM 1396 and PM 1451, all of which are commercially available from 3M Specialty Chemicals Division (St. Paul, Minn.); NRD-372 and N 140, both of which are commercially available from DuPont Flooring Systems (Wilmington, Del.); TG-232D, which is commercially available from Advanced Polymers, Inc. (Salem, N.H.); and Nuva CPA, which is commercially available from Clariant Corporation (Charlotte, N.C.). Desirably, the aqueous treating compositions of the present invention contain at least one fluorochemical compound, wherein the fluorochemical compound is DAIKIN TG 3311.

The amount of fluorochemical compound in the aqueous treating compositions of the present invention will be set to produce a desired level on the carpet yarn. Desirably, the fluorochemical compound is present in the aqueous treating composition in an amount up to about 3.0 percent by weight (pbw) solids, based on a total weight of the aqueous treating composition. More desirably, the fluorochemical compound is present in an amount ranging from about 0.01 pbw to about 2.0 pbw solids, based on a total weight of the aqueous treating composition. Even more desirably, the fluorochemical compound is present in an amount ranging from about 0.02 pbw to about 0.10 pbw solids, based on a total weight of the aqueous treating composition.

The fluorochemical compounds suitable for use in the present invention may be generally described as any fluorochemical compound that produces a stable solution or dispersion when incorporated into the application baths described herein. The most desirable fluorochemical compounds for use in the present invention are anionic fluorochemical compounds, since these compounds are the more stable in solutions having an acidic pH and containing other chemicals described below. Non-ionic fluorochemical compounds may also be useful in the present invention. Further, cationic fluorochemical compounds may also be useful in the present invention.

B. Organosilicate Compounds

The aqueous treating compositions of the present invention also contain at least one organosilicate compound. Suitable organosilicate compounds for use in the present invention include, but are not limited to, organosilicate compounds disclosed in U.S. Pat. Nos. 4,351,736 and 4,781,844, both of which are assigned to Bayer Aktiengesellschaft (Leverkusen, Germany), and both of which are incorporated herein by reference in their entirety. As disclosed in U.S. Pat. No. 4,351,736 (hereinafter, "the '736 patent") and U.S. Pat. No. 4,781,844 (hereinafter, "the '844 patent"), the organosilicates are formed from one or more silanes selected from (i) silanes having the general formula $RSi(OR')_3$ and (ii) silanes having the general formula $Si(OR')_4$ wherein R represents a substituted or unsubstituted hydrocarbon radical having from 1 to 7 carbon atoms and substituents selected from halogens, amino groups, mercapto groups, and epoxy groups, and R' represents an alkyl radical having from 1 to 4 carbon atoms.

The organosilicate compounds are formed by mixing the silanes with water, a buffer substance, a surface-active agent, and when appropriate, an organic solvent, and agitating the mixture under acidic or basic conditions. Desirably, the resulting polymers are formed from about 2 to about 50 percent by weight, more desirably, about 3 to about 20 percent by weight, of silanes having the general formula $Si(OR')_4$ based on a total weight of silanes used to form the polymers. Desired silanes for forming the organosilicate compounds include, but are not limited to, methyltrimethoxysilane, methyltriethoxysilane, methyltriisopropoxysilane, ethyltrimethoxysilane, ethyltriethoxysilane, propyltrimethoxysilane, isobutyltrimethoxysilane, isobutyltriethoxysilane, 2-ethylbutyltriethoxysilane, tetraethoxysilane, 2-ethylbutoxytriethoxysilane, and combinations thereof. Desirably, the surface-active agent comprises a cationic compound containing a halide, more desirably, a chloride or bromide containing compound.

Several commercially available organosilicate compounds are suitable for use in the present invention. Suitable organosilicate materials include, but are not limited to, BAYGARD® AS and BAYGARD® SNF, both of which are commercially available from Bayer Specialty Chemicals (Wellford, S.C.). Desirably, the aqueous treating compositions of the present invention contain at least one organosilicate compound, wherein the organosilicate compound is BAYGARD® SNF.

The amount of organosilicate compound in the aqueous treating compositions of the present invention will be set to produce a desired level on the carpet yarn. Desirably, the organosilicate compound is present in the aqueous treating composition in an amount up to about 3.0 pbw solids, based on a total weight of the aqueous treating composition. More desirably, the organosilicate compound is present in an amount ranging from about 0.001 pbw to about 2.0 pbw solids, based on a total weight of the aqueous treating composition. Even more desirably, the organosilicate compound is present in an amount ranging from about 0.006 pbw to about 1.0 pbw solids, based on a total weight of the aqueous treating composition.

C. pH Adjusting Agent

An important feature of the aqueous treating composition of the present invention is the pH. Desirably, the pH of the aqueous treating composition is below about 3.5. A pH of below about 3.5 is lower than the pH of conventional fluorochemical compositions applied to carpets. It is believed that the lower pH helps drive the fluorochemical out of solution and onto/into the carpet yarn fibers. More desirably, the pH of the aqueous treating composition is above about 1.0 and below about 2.5, even more desirably, below about 2.0, and even more desirably, between about 1.5 and about 1.8.

A desired pH may be obtained by adding an appropriate amount of an acid to the aqueous treating composition. Suitable acids for use in the present invention include, but are not limited to, urea sulfate and sulfamic acid.

D. Anionic Polymer-Binding Compound

The aqueous treating compositions may also include an anionic polymer-binding compound. The anionic polymer-binding compound may also serve as a stain-resist compound, although this function is not required. For example, when the carpet yarn is made from polypropylene, there are no acid dye sites for the anionic polymer-binding compound to block. Nevertheless, it has been discovered that the use of an anionic polymer-binding compound improves the performance of the fluorochemical compound on polypropylene carpet yarn, as well as other yarns. While not wishing to be bound by any particular theory, it is that the anionic polymer-binding compound functions to hold the fluorochemical onto the surface of the fiber.

Several anionic polymer-binding compounds also function as stain-resist compounds on nylon carpet yarn and have been found to work well in the present invention. Exemplary anionic polymer-binding compounds are polymers or copolymers of methacrylic acid. Desirably, these polymers or copolymers have a molecular weight range such that the lower 90 weight percent has a weight average molecular weight in the range of about 2500 to 250,000 and a number average molecular weight in the range of 500 to 20,000. One particularly desirable anionic polymer-binding compound is a polymethacrylic acid commercially available from Rohm & Haas under the designation LEUKOTAN® 1028. The molecular weight of the lower 90 weight percent based on weight average for LEUKOTAN® 1028 is reported to be 9,460 and based on number average is reported to be 5,592.

Another particularly desirable anionic polymer-binding compound is a polymer of methacrylic acid designated XP-4-49, which is made by the following procedure. Into a reaction vessel, equipped with a reflux condenser, heating, agitation, thermometer, and an inert gas blanket, is added 54 lbs of methacrylic acid, 452 lbs of water, and 1.0 lbs of NaOH. This mixture is referred to as aqueous phase A. Monomer feed B is prepared by mixing 214 lbs of methacrylic acid, 303 lbs of water, 0.16 lbs of diallyl maleate and 2.2 lbs of NaOH. Two catalyst feeds C and D are also prepared. Feed C consists of 2.2 lbs potassium persulfate and 197 lbs of water. Feed D consists of 2.2 lbs of sodium metabisulfite and 197 lbs of water.

Mixture A is heated to a temperature of about 85° C. to about 90° C. under a nitrogen blanket for 30 minutes. 1.3 lbs of potassium persulfate and 1.3 lbs of sodium metabisulfite are added to initiate the reaction, resulting in a small exotherm of about 3° C. to about 5° C. Feeds B, C and D are then added to the reaction vessel over a period of about one hour with the temperature of the vessel maintained at about 90° C. to about 95° C. At the end of the addition period, the batch is held at a temperature of about 90° C. to about 95° C. for one hour. During this hour, 0.35 lbs of potassium persulfate, 0.35 lbs of sodium metabisulfite and 2.2 lbs NaOH are added every 15 minutes for a total of 3 additions.

The resulting product, referred to as XP-4-49, is a slightly hazy, viscous liquid with 20.4% solids, a pH of 3.7 and a viscosity of 4800 cps measured on a Brookfield Viscometer with a #2 spindle at room temperature.

Desirably, the XP-4-49 is mixed with a lesser amount of a phenolic type stain-resist compound sold by Sybron Chemicals, Inc. (Birmingham, N.J.), now a division of Bayer Chemicals (Baytown, Tex.), under the designation "Tanatex Stainfree." The desired ratio of XP-449 to Tanatex is about 18:1 based on solids. In one exemplary embodiment, 73.1 parts of XP-4-49, including the water in which it is made, is added to 24.5 parts water and 2.4 parts Sybron Stainfree. The resulting mixture is a clear, viscous, amber liquid with a final viscosity of about 68 cps. This particular mixture is designated XP-4-50 and is a desirable anionic polymer-binding/stain-resist compound for use in the method of the present invention.

Other anionic polymer-binding/stain-resist compounds have also been shown to work well. The following compositions from 3M Specialty Chemicals Division (St. Paul, Minn.) have worked well: FX-369, FX-668F, FX-661, and FX-657. The principal ingredient of FX-369 is believed to be a phenolic resin. All of the other 3M stain-resist compositions are believed to comprise a methacrylic acid polymer or copolymer and are believed to be described in at least one of U.S. Pat. Nos. 4,937,123 and 4,822,373, both of which are assigned to the 3M Company (St. Paul, Minn.).

Another suitable anionic polymer-binding/stain-resist compound for use in the present invention is a product sold by DuPont Flooring Systems (Wilmington, Del.) under the trade designation "SR 500." SR 500 is a proprietary composition with a styrene-maleic anhydride copolymer as the principal ingredient.

In addition to LEUKOTAN® 1028 referred to above, other LEUKOTAN® compounds from Rohm & Haas are useful in the present invention, in particular, LEUKOTAN® 1027, 970 and 1084. With the exception of the LEUKOTAN® 1084, the LEUKOTAN® compositions are all polymers and copolymers of methacrylic acid of varying molecular weights. Although these compounds are generally sold to the tanning industry, U.S. Pat. No. 4,937,123 (assigned to the 3M Company, St. Paul, Minn.) refers to this group as having stain-resist properties when applied to nylon carpet fibers. LEUKOTAN® 1084 is believed to be a polymer of acrylic acid. The stain resist material from Peach State Labs (Rome, Ga.), known as RM, has also shown to be useful in the described invention. The RM product is thought to be a modified phenolic material.

Desirably, the anionic polymer-binding compound is present in the aqueous treating composition in an amount up to about 2.0 pbw solids, based on a total weight of the aqueous treating composition. More desirably, the anionic polymer-binding compound is present in an amount ranging from about 0.005 pbw to about 0.6 pbw solids, based on a total weight of the aqueous treating composition. Even more desirably, the anionic polymer-binding compound is present in an amount ranging from about 0.03 pbw to about 0.3 pbw solids, based on a total weight of the aqueous treating composition E. Other Optional Components The aqueous treating compositions may also include the following optional components.

1. Colorants

In some cases, the aqueous treating compositions may also include one or more colorants including dyes and pigments. For example, when the carpet yarn or carpet comprises nylon or polyester fibers, a dye may be added to the aqueous treating composition.

III. Method of Making the Treating Composition

The aqueous treating composition may be prepared using the following exemplary procedure. Typically, the fluorochemical, organosilicate polymer and stain-resist compounds are provided by the manufacturer in a concentrated aqueous dispersion. These concentrates can be simply added to water in a mixing vessel and stirred at room temperature. Because some of the fluorochemical and/or stain-resist compositions are in emulsion form, which may be sensitive to high shear, stirring is desirably done at low shear. The pH is measured and an appropriate amount of acid is added to bring the pH to a desired level.

In one exemplary embodiment of the present invention, the aqueous treating composition is prepared by first adding a desired amount of water to a vessel. The anionic binding compound, when present, is then added, followed by the organosilicate compound, then the fluorochemical compound, and lastly the acid to adjust the pH of the composition. The aqueous treating compositions may be prepared as a batch, in a holding tank, for delivery to the application equipment, or, alternatively, may be prepared in a continuous mixing fashion, for direct application, with no need for a holding vessel, by using pumps, flow meters and static or dynamic mixing equipment.

IV. Method of Treating Carpet Yarns and Carpets

The present invention is further directed to methods of treating carpet yarns and carpets by contacting the carpet yarns and/or carpets with the above-described aqueous treating composition. In one desired embodiment of the present invention, carpet yarn is immersed in the aqueous treating composition. Desirably, this is accomplished by immersing carpet in a bath of the aqueous treating composition. More desirably, the carpet is immersed by drawing the carpet through a puddle of the aqueous treating composition in an apparatus such as that known in the industry as a "flex nip applicator." Alternatively, the carpet may be placed in a vessel containing the aqueous treating composition, such as a dyeing vessel. Still further, the aqueous treating composition may be sprayed or cascaded onto the carpet so as to immerse the carpet.

The amount of aqueous treating composition applied to the carpet or carpet yarn is desirably an amount so as to provide a ratio of carpet (or carpet yarn) to aqueous treating composition of at least about 0.5 to 1. A common expression for the amount of liquid applied to carpet is "wet pick-up." Using this expression, the desired wet pick-up is at least about 50 percent (i.e., at least about 50 grams of aqueous treating composition is "picked-up" by 100 grams of carpet or carpet yarn). More desirably, the wet pick-up is between about 50 percent and about 6000 percent (i.e. a ratio of about 0.5:1 to about 60:1). Even more desirably, the wet pick-up is between about 200 and about 500% (i.e. a ratio of about 2:1 to about 5:1). Control of the wet pick-up level may be accomplished by conventional means, such as squeeze rollers and the like.

Heating the aqueous treating composition in contact with the carpet yarn has been found to enhance the performance of the method of the present invention. As shown in the examples below, a heating step greatly shortens the time needed to get good exhaustion of the fluorochemical compound onto the carpet fiber. Thus, although not required, the heating step greatly improves the efficiency of the method. While not wishing to be bound by any particular theory, it is believed that the heat treatment helps cure or fix the molecules of fluorochemical compound to the carpet yarn fibers.

In one embodiment of the present invention, a heating step is performed at a temperature from about 160° F. (71° C.) to about 260° F. (127° C.) for a period of time ranging from about 15 second to about 60 minutes, more desirably at a temperature from about 180° F. (82° C.) to about 220° F. (104° C.) for a period of time ranging from about 30 second to about 8 minutes. Even more desirably, the heating step is accomplished by exposing the carpet treated with the aqueous treating composition to steam at ambient pressure, i.e. 212° F. (100° C.) for up to about 90 seconds.

After the heating step, the carpet is desirably rinsed to remove excess chemicals. The rinsing step may be done by any conventional means. After rinsing, excess water is desirably removed by conventional means, such as a vacuum extractor. Typically, the water content after extracting is from about 20 to about 30 percent based on a total weight of the carpet. After excess water is removed from the carpet, the carpet is typically dried in a flow-through oven. Desirably, the carpet is dried at a drying temperature of no greater than 250° F. (° C.) for a drying period of about 2 to about 3 minutes.

In one embodiment of the present invention, the aqueous treating composition is applied to a carpet yarn or carpet during a dyeing process. In this embodiment, the aqueous treating composition further contains a dye, such as one or more acid dyes.

Desirably, the present method of treating fibers, carpet yarns and carpets results in fibers, carpet yarns and carpets containing greater than about 70% of a theoretical amount of fluorine for a given application at a 100% exhaustion rate regardless of whether the fiber comprises polyamide, polyester, polypropylene, or a combination thereof. In other words, the present method of treating fibers, carpet yarns and carpets has an F1 exhaustion efficiency of greater than about 70% based on a theoretical 100% F1 exhaustion rate for fibers comprises polyamide, polyester, polypropylene, or a combination thereof. For example, if the theoretical amount of fluorine in a given fiber or carpet yarn is 400 ppm F1 for a given application at a 100% exhaustion rate, the present method desirably results in a fiber or carpet yarn having a fluorine content of at least about 280 ppm F1. More desirably, the present method of treating fibers, carpet yarns and carpets results in fibers, carpet yarns and carpets containing greater than about 80% (i.e., F1 exhaustion efficiency of greater than about 80%), even more desirably, 90% (i.e., F1 exhaustion efficiency of greater than about 90%), of a theoretical amount of fluorine for a given application at a 100% exhaustion rate.

In one desired embodiment of the present invention, the present method of treating fibers, carpet yarns and carpets has an F1 exhaustion efficiency of greater than about 70% based on a theoretical 100% F1 exhaustion rate while limiting the exposure of the treated fibers, carpet yarns and/or carpets to steam regardless of whether the fibers or carpet yarns comprises polyamide, polyester, polypropylene, or a combination thereof. Desirably, the present method of treating fibers, carpet yarns and carpets has an F1 exhaustion efficiency of greater than about 70%, more desirably, greater than about 80%, and even more desirably, greater than about 90%, while limiting the exposure of the treated fibers, carpet yarns and/or carpets to steam to less than 90 seconds, desirably, less than 60 seconds, and even more desirably less than 45 seconds.

V. Treated Fibers, Carpet Yarns and Carpets

The present invention is further directed to treated fibers, carpet yarns and carpets having a desired level of fluorochemical compound and organosilicate compound on the fiber, carpet yarn or carpet. Desirably, the treated fiber or carpet yarn contains a fluorochemical compound in an amount of up to about 2.0 pbw, based on a total weight of the dried fiber or carpet yarn. More desirably, the treated fiber or carpet yarn contains a fluorochemical compound in an amount ranging from about 0.1 pbw to about 2.0 pbw, based on a total weight of the dried fiber or carpet yarn. Even more desirably, the treated fiber or carpet yarn contains a fluorochemical compound in an amount ranging from about 0.2 pbw to about 0.8 pbw, based on a total weight of the dried fiber or carpet yarn.

In addition, it is desirable for the treated fiber or carpet yarn to contain an organosilicate compound in an amount of up to about 2.0 pbw, based on a total weight of the dried fiber or carpet yarn. More desirably, the treated fiber or carpet yarn contains an organosilicate compound in an amount ranging from about 0.05 pbw to about 0.75 pbw based on a total weight of the dried fiber or carpet yarn. Even more desirably, the treated fiber or carpet yarns contain an organosilicate compound in an amount ranging from about 0.1 pbw to about 0.3 pbw, based on a total weight of the dried fiber or carpet yarn.

The treated fiber or carpet yarn may optionally comprise an anionic polymer-binding compound (and/or stain-resist compound). In one exemplary embodiment of the present invention, the treated fiber or carpet yarn contains an anionic polymer-binding compound (and/or stain-resist compound), when present, in an amount of up to about 2.0 pbw, based on a total weight of the dried fiber or carpet yarn. More desirably, the treated fiber or carpet yarn contains an anionic polymer-binding compound (and/or stain-resist compound), when present, in an amount ranging from about 0.2 pbw to about 3.0 pbw, based on a total weight of the dried fiber or carpet yarn. Even more desirably, the treated fiber or carpet yarns contain an anionic polymer-binding compound (and/or stain-resist compound), when present, in an amount ranging from about 0.4 pbw to about 1.0 pbw, based on a total weight of the dried fiber or carpet yarn.

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLES

The following materials were used in the following examples.

Carpet Construction

The pieces of carpet used in the following examples were made with the various face yarns as noted below:

Where the example refers to S916 greige, this is a carpet sample formed from polyester staple fibers (Nanya Plastics Corporation, Lake City, S.C.), which have been subjected to a Suessen set process.

Where the example refers to H689 greige, this is a carpet sample formed from 1560 denier polyester filaments (Shaw Industries, Dalton, Ga.), which have been subjected to a Superba set process.

Where the example refers to R&D 48-9435, this is a carpet sample formed from poly(trimethylene terephthalate) (PTT) filaments (Shaw Industries, Dalton, Ga.).

Where the example refers to 3883 greige, this is a carpet sample formed from polypropylene cut pile fibers.

Where the example refers to X797 greige, this is a carpet sample formed from type 6 nylon filament loop pile fibers (Shaw Industries, Dalton, Ga.), which have been subjected to a Superba set process.

Methods Used in Examples

Except for the variances noted below, the examples were all performed according to the following methods:

Application of Fluorochemicals and Organosilicate Compounds from a Bath

In the examples below, a fluorochemical and a cationic organosilicate polymer were applied by immersing the extracted sample pieces in an aqueous treating composition containing a fluorochemical compound and an organosilicate polymer described above. The liquor in the flat pan applicator for these examples was made up with anionic fluorochemical in an amount ranging from 0.2 pbw to 0.8 pbw and the organosilicate polymer in an amount ranging from 0.2 pbw to 0.3 pbw, based on a total weight of the article or fabric to be treated, and an acid for pH adjustment to the desired range. The extracted fabric was wet out in this liquor, in the 350-400% wet-pick-up range, and subsequently steamed.

Steaming

The wet-out sample pieces were placed in the horizontal steamer for 60 seconds of steaming to fix the fluorochemical and the organosilicate compound on the carpet fibers. The fabric was steamed for 30 seconds with the tufted pile up, and 30 seconds with the tufted pile down to achieve liquor flow.

Rinse/Extraction

The steamed sample pieces were then removed from the steamer and immersed in a 3 gallon volume of ambient tap water, for 10 to 15 seconds, to simulate a washing step. The sample pieces were then extracted in a high speed BOCK centrifuge for 4 minutes to pull the moisture level down to the 20-30% WPU range.

Drying

The extracted sample pieces, or the pieces with a topical application of fluorochemical, were then placed, with the pile up, in an electrically heated, forced air oven operating at 225° F. (107° C.) for 5 minutes. The sample pieces had a moisture content in the range of 1-2% when removed from the oven.

Test Methods

The products of the examples were tested by one or more of the following test methods:

PPM Fluorine

The test used to measure the level of fluorochemical applied to a carpet sample was the "NYLON FLUORINE CONTENT—COMBUSTION FLASK OXIDATION/SPECIFIC ION METER" test published in October 1983 by the Textile Fibers Department of E.I. DuPont De Nemours & Company, Inc. under the number TM-0371-66, N-M 27414.00. Briefly stated, the test is conducted by burning the sample in an oxygen combustion flask. The fluoride is absorbed in a sodium hydroxide solution and the pH and ionic strength of that solution is adjusted. The concentration (activity) of the fluoride ion is measured potentiometrically. The results are reported as parts per million fluorine.

Example 1

Application of Fluorochemicals Alone and With an Organosilicate Polymer

The following carpet sample substrates were prepared:

1—S916 greige—Nanya polyester staple Suessen set
2—H689 greige—Shaw 1560's polyester filament Superba set
3—R&D 48-9435—Shaw PTT Filament
4-3883 greige—Polypropylene cut pile
5—X797 greige—Shaw T6 Superba Nylon Loop pile Each sample was rinsed at 400% wpu with a non-ionic surfactant solution at pH 4, steamed for 180 seconds, rinsed with fresh water, and then extracted down to 20% wpu range using a high-speed centrifuge. The rinsed, extracted greige samples were then treated with the aqueous treating compositions described below, steamed for 60 seconds, rinsed with fresh water, extracted with a high speed centrifuge, and dried in a flow through oven at 225° F. (107° C.) for five minutes.

Treatment Bath 1—Control, No Organosilicate Polymer Present:

- Water—400% wpu based on greige weight
- Fluorochemical—DAIKIN TG 3311, 12.5% active fluorine, 0.30% owf (owf=on weight of fiber)
- pH Adjusting Agent—A-80 N acid (Urea Sulfate, Peach State Labs, Rome, Ga.), 2.5% owf
- Final pH—1.7 to 1.75

Treatment Bath 2—BAYGARD® SNF Polymer Test:

- Water—400% wpu based on greige weight
- Fluorochemical—DAIKIN TG 3311, 12.5% active fluorine, 0.30% owf BAYGARD® SNF, cationic organosilicate polymer, 0.25% owf pH Adjusting Agent—A-80 N acid (Urea Sulfate, Peach State Labs, Rome, Ga.), 2.5% owf Final pH—1.7 to 1.75

Samples 1-4 were treated with the Treatment Bath 1 formulation and the Treatment Bath 2 formulation as shown above. Sample 5 was treated with (i) the Treatment Bath 1 formulation as shown above, and (ii) the Treatment Bath 2 formulation shown above with the addition of 1.0% owf of 3M FX 657 stain resist compound.

The samples were then tested for fluorine content to measure the exhaustion rate. Test results are shown below in Table 1.

TABLE 1

| | ppm Fluorine | |
|---|---|---|
| Sample | Treatment Bath 1 ppm F1 | Treatment Bath 2 ppm F1 |
| 1 | 262 | 332 |
| 2 | 194 | 278 |
| 3 | 211 | 358 |
| 4 | 271 | 345 |
| 5 | 323 | 387 |

The theoretical ppm fluorine for this application is 380 ppm at a 100% exhaustion rate. As shown in Table 1 above, inclusion of an organosilicate compound in the aqueous treating composition significantly increased the exhaustion of fluorine into the carpet samples.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method of treating a fiber comprising the steps of:

(a) providing a fiber;

(b) applying an aqueous treating composition to the fiber by immersing the fiber in a bath containing the treating composition, wherein the aqueous treating composition comprises:

(i) a fluorochemical compound;

(ii) a cationic organosilicate compound; and (iii) an acid to provide a pH for the aqueous treating composition of below about 3.5:

(c) heating the fiber with steam; and (d) removing excess water from the treated fiber, wherein the fluorine exhaustion efficiency of the method is greater than about 70%.

2. The method of claim 1, wherein the fluorochemical compound is selected from the group consisting of telomeric and electrochemically fluorinated fluorochemicals.

3. The method of claim 1, wherein the fluorochemical compound is present in the aqueous treating composition in an amount ranging from about 0.02 to about 0.1 percent by weight solids based on a total weight of the aqueous treating composition.

4. The method of claim 1, wherein the organosilicate compound is present in the aqueous treating composition in an amount ranging from about 0.006 to about 1.0 percent by weight solids based on a total weight of the aqueous treating composition.

5. The method of claim 1, wherein the fiber is heated at a temperature between about 160° F. (71° C.) and about 260° F. (127° C.) for between about 15 seconds and about 60 minutes.

6. The method of claim 1, wherein the fiber comprises a carpet yarn, and the carpet yarn is tufted into a carpet before the aqueous treating composition is applied.

7. The method of claim 1, wherein the fiber comprises a carpet yarn, and a weight ratio of the aqueous treating composition to the carpet yarn during the heating step is at least 0.5:1.

8. The method of claim 7, wherein a weight ratio of the aqueous treating composition to the carpet yarn during the heating step is between about 2:1 and about 60:1.

9. The method of claim 1, wherein the fiber comprises a carpet yarn, and the carpet yarn is immersed in the aqueous treating composition by placing the carpet yarn in a vessel containing the aqueous treating composition.

10. The method of claim 9, wherein the carpet yarn is removed from the vessel before a heating step, wherein the aqueous treating composition and the carpet yarn are present at a weight ratio of at least about 0.5:1 during the heating step.

11. The method of claim 10, wherein a weight ratio of the aqueous treating composition to the carpet yarn during the heating step is between about 2:1 to about 10:1.

12. The method of claim 9, wherein the carpet yarn and the aqueous treating composition are heated in the vessel.

13. The method of claim 1, wherein the fiber comprises polyester, polypropylene, polyamide, or a combination thereof.

14. The method of claim 1, wherein the fiber comprises polyamide and the aqueous treating composition further comprises an anionic polymer-binding compound in an amount of up to about 4.0 percent by weight solids based on a total weight of the aqueous treating composition.

15. The method of claim 13, wherein the fiber comprises polyester fibers and the aqueous treating composition further comprises a dye for the polyester fibers.

16. The method of claim 1, wherein the pH is below about 2.5.

17. The method of claim 1, wherein the pH is below about 2.0.

18. The method of claim 1, wherein the pH is between about 1.5 and about 1.8.

19. The method of claim 1, wherein the organosilicate compound is formed from (i) silanes having a first formula $R—Si(OR')_3$ and (ii) silanes having a second formula $Si(OR')_4$ wherein R represents a substituted or unsubstituted hydrocarbon radical having from 1 to 7 carbon atoms with substituents selected from halogens, amino groups, mercapto groups, and epoxy groups, and R' represents an alkyl radical having from 1 to 4 carbon atoms.

20. A method of treating a fiber comprising the steps of:

(a) providing a fiber, wherein the fiber is a carpet yarn comprising polymeric fibers;

(b) applying an aqueous treating composition to the carpet yarn by immersing the carpet yarn in a bath containing the treating composition, wherein the aqueous treating composition comprises:

(i) a fluorochemical compound;

(ii) an organosilicate compound; and (iii) an acid to provide the aqueous treating composition with a pH of below about 2.0;

(c) heating the fiber with steam; and (d) removing excess water from the treated carpet yarn, wherein the fluorine exhaustion efficiency of the method is greater than about 70%.

21. The method of claim 20, wherein the pH is between about 1.5 and about 1.8.

22. The method of claim 20, wherein the fluorochemical compound is present in the aqueous treating composition in an amount of up to about 2.0 percent by weight solids based on a total weight of the aqueous treating composition.

23. The method of claim 20, wherein the organosilicate compound is present in the aqueous treating composition in an amount of up to about 2.0 percent by weight solids based on a total weight of the aqueous treating composition.

24. The method of claim 23, wherein the organosilicate compound is formed from (i) silanes having a first formula $R—Si(OR')_3$ and (ii) silanes having a second formula $Si(OR')_4$ wherein R represents a substituted or unsubstituted hydrocarbon radical having from 1 to 7 carbon atoms with substituents selected from halogens, amino groups, mercapto groups, and epoxy groups, and R' represents an alkyl radical having from 1 to 4 carbon atoms.

25. A method of increasing fluorine exhaustion onto a fiber comprising the steps of:

(a) immersing the fiber in an acidic bath comprising a cationic organosilicate compound, and a fluorochemical compound; and (b) steaming the treated fiber;

wherein the fluorine exhaustion efficiency of the method is greater than about 70%, and the pH is below about 3.5.

26. The method of claim 25, wherein the fluorine exhaustion efficiency is greater than about 80%.

27. The method of claim 25, wherein the fluorine exhaustion efficiency is greater than about 90%.

28. The method of claim 25, wherein the organosilicate compounds are formed from (i) silanes having a first formula $R—Si(OR')_3$ and (ii) silanes having a second formula $Si(OR')_4$ wherein R represents a substituted or unsubstituted hydrocarbon radical having from 1 to 7 carbon atoms with substituents selected from halogens, amino groups, mercapto groups, and epoxy groups, and R' represents an alkyl radical having from 1 to 4 carbon atoms.

29. The method of claim 25, wherein the fiber comprises polyamide, polyester, polypropylene, or a combination thereof.

30. The method of claim 1, wherein the fluorochemical compound is an anionic fluoropolymer.

31. The method of claim 1, wherein the fluorochemical compound is a non-ionic fluoropolymer.

32. The method of claim 1, wherein the organosilicate compound contains a halogen substituted hydrocarbon substituent.

33. The method of claim 14, wherein the anionic polymer-binding compound is a polyacrylic acid.

* * * * *

UNITED STATES PATENT AND TRADEMARK OFFICE

CERTIFICATE OF CORRECTION

PATENT NO. : 7,335,234 B2
APPLICATION NO. : 10/271808
DATED : February 26, 2008
INVENTOR(S) : Dennis J. Jones, Jr.

It is certified that error appears in the above-identified patent and that said Letters Patent is hereby corrected as shown below:

Column 12, line 65, “an organosilicate” should be changed to --a cationic organosilicate--; and Column 13, line 1, “fiber” should be changed to --treated carpet yarn--.

Signed and Sealed this

Nineteenth Day of August, 2008

JON W. DUDAS
*Director of the United States Patent and Trademark Office*